United States Patent [19]

Bourne

[11] Patent Number: 4,548,435

[45] Date of Patent: Oct. 22, 1985

[54] LATCH ASSEMBLY CHANNEL

[75] Inventor: William R. Bourne, Anaheim, Calif.

[73] Assignee: Hartwell Corporation, Placentia, Calif.

[21] Appl. No.: 137,554

[22] Filed: Apr. 4, 1980

[51] Int. Cl.[4] ..... E05C 3/02

[52] U.S. Cl. ..... 292/229; 292/195

[58] Field of Search ..... 292/229, 214, DIG. 24, 292/195, 196; 70/141

[56] References Cited

U.S. PATENT DOCUMENTS

| | | | |
|---|---|---|---|
| 1,700,093 | 1/1929 | Hamm | 292/195 X |
| 2,218,183 | 10/1940 | Springer | 252/229 X |
| 2,594,940 | 4/1952 | Levine | 292/229 X |
| 2,717,796 | 9/1955 | Cudney | 292/229 |
| 2,722,445 | 11/1955 | Cudney | 292/229 |
| 2,977,785 | 4/1961 | Beckman | 292/229 X |
| 3,240,523 | 3/1966 | Heimann | 292/229 X |
| 3,378,289 | 4/1968 | Beckman et al. | 292/229 X |

FOREIGN PATENT DOCUMENTS

| | | | |
|---|---|---|---|
| 1345696 | 11/1963 | France | 292/195 |

*Primary Examiner*—Roy D. Frazier
*Assistant Examiner*—Peter A. Aschenbrenner
*Attorney, Agent, or Firm*—Lyon & Lyon

[57] ABSTRACT

A latch assembly wherein a latch bolt and a latch trigger are unlatched by rotation of a sleeve adjacent the latch trigger which causes the latch trigger to pivot out of engagement with the latch bolt.

11 Claims, 4 Drawing Figures

LATCH ASSEMBLY CHANNEL

BACKGROUND OF THE INVENTION

This invention is directed to a latch assembly which provides a means for opening the latch which ensures that the latch will not be inadvertently opened due to external loadings or vibrations of the latch assembly. The latch mechanism of this invention may be utilized for securing exterior panels of aircraft which must be periodically removed for maintenance of the aircraft and the like. It is of the utmost importance that such latches remain secured when the panels are exposed to external forces such as wind loading and vibration which may occur during operation of the aircraft.

SUMMARY OF THE INVENTION

This invention is directed to a latch assembly including a latch bolt and a latch trigger, the latch trigger having a protrusion adapted for engagement within a latch bolt recess. The latch trigger is urged out of engagement with the latch bolt upon rotation of a sleeve which is positioned adjacent the latch trigger.

DESCRIPTION OF PREFERRED EMBODIMENTS

Figure 2:
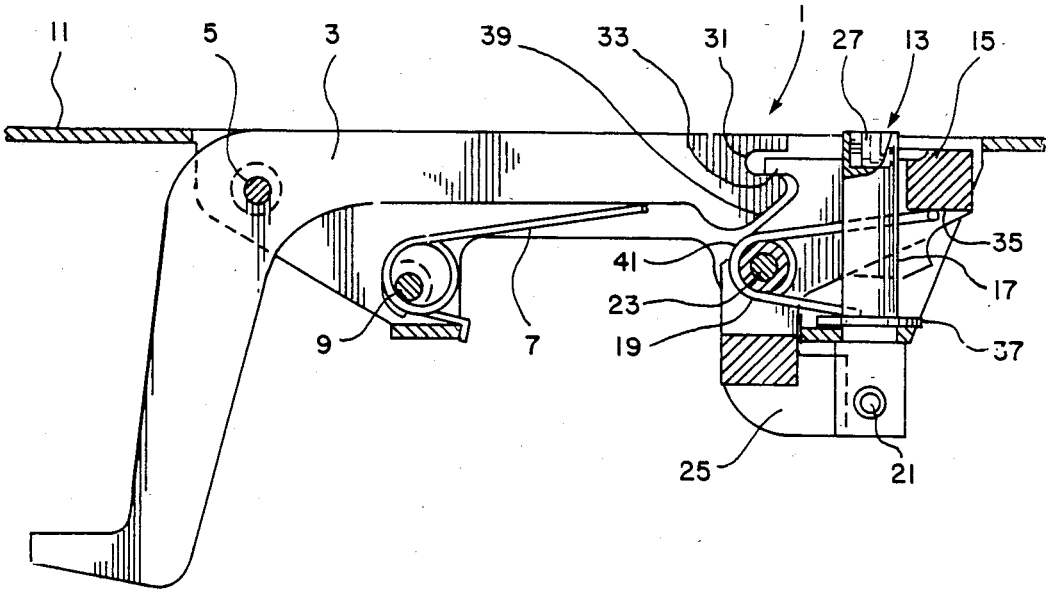
FIG. 2 is a cross-sectional side view of the latch assembly of this invention.

Referring now to the figures of drawings, a detailed description of this invention will be set out. Referring specifically to FIG. 2, a latch assembly 1 is shown including a latch bolt means 3 adapted for pivotal movement about a latch bolt means pivot 5, latch bolt means pivot 5 being a fixed pivot. A latch bolt means biasing member 7, preferably a torsional coil spring is positioned about a fixed latch bolt means biasing member pin 9 and bears against the latch bolt means 3.

Figure 1:
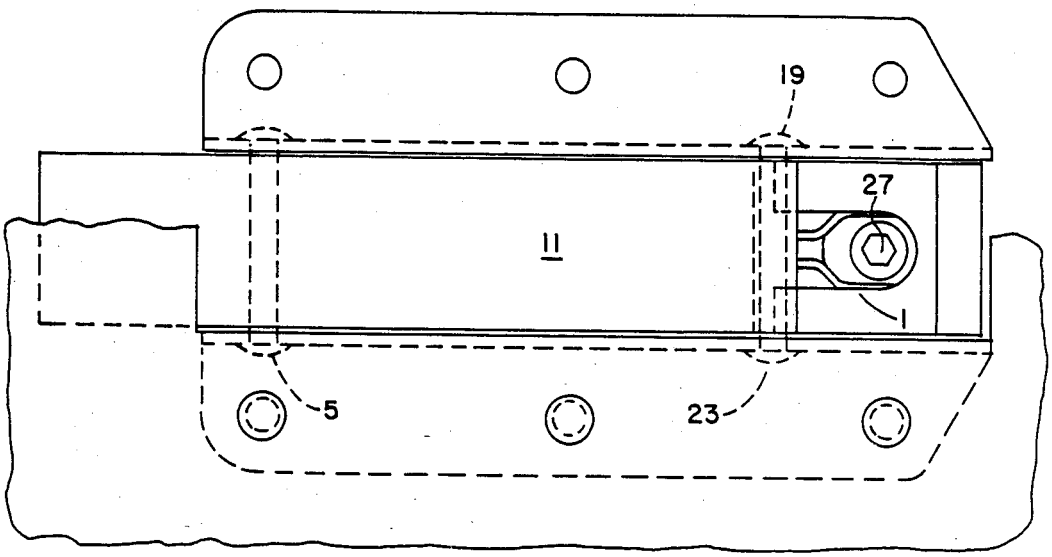
FIG. 1 is a top view of the latch assembly of this invention.

As shown in FIGS. 1 and 2 when the latch assembly is in the latch position as illustrated in FIG. 2, the latch bolt means 3 is substantially flushed with skin 11 of the surrounding panel surface. Actuator assembly 13 for latching and unlatching the latch assembly 1 includes a latch trigger means 15 and a rotatable shaft 17. Latch trigger means biasing means 19 is preferably a torsional coil spring and bears against the pivotal latch trigger means 15. The rotatable sleeve 17 includes a cross pin 21 which is fixed to the exterior of the rotatable shaft 17. The latch trigger means 15 is adapted to pivot about a fixed latch trigger means pivot 23. The latch trigger means biasing means 19 is preferably coiled about latch trigger means pivot 23. The latch trigger means 15 includes a pair of latch trigger means leg 25.

Figure 4:
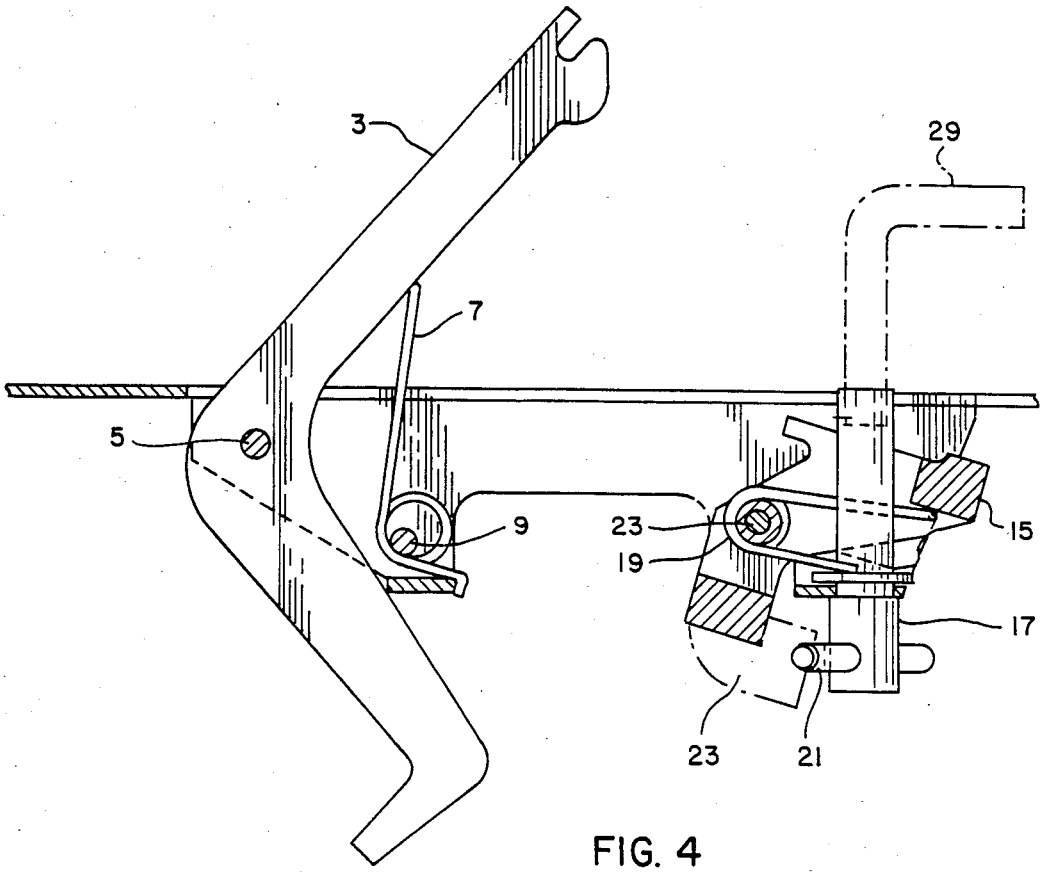
FIG. 4 is a cross-sectional side view of the latch assembly of this invention illustrating the latch assembly in the unlatched position.

The rotatable shaft 17 preferably includes a recess 27 adapted to accommodate an operating tool such as 29 shown in FIG. 4 for operative rotation of the rotatable shaft 17. The latch bolt means 3 includes a latch bolt means recess 31 adapted for engagement by a latch trigger means protrusion 33. The latch trigger means 15 includes a latch trigger means shoulder 35 and the rotatable sleeve 17 includes a shaft shoulder 37. The latch trigger means biasing means 19 is preferably positioned such as to urge the rotatable sleeve shoulder 37 from the latch trigger means shoulder 35. The latch trigger means 15 further includes a latch trigger means face 41 adapted for engagement by a latch bolt means 39.

Figure 3:
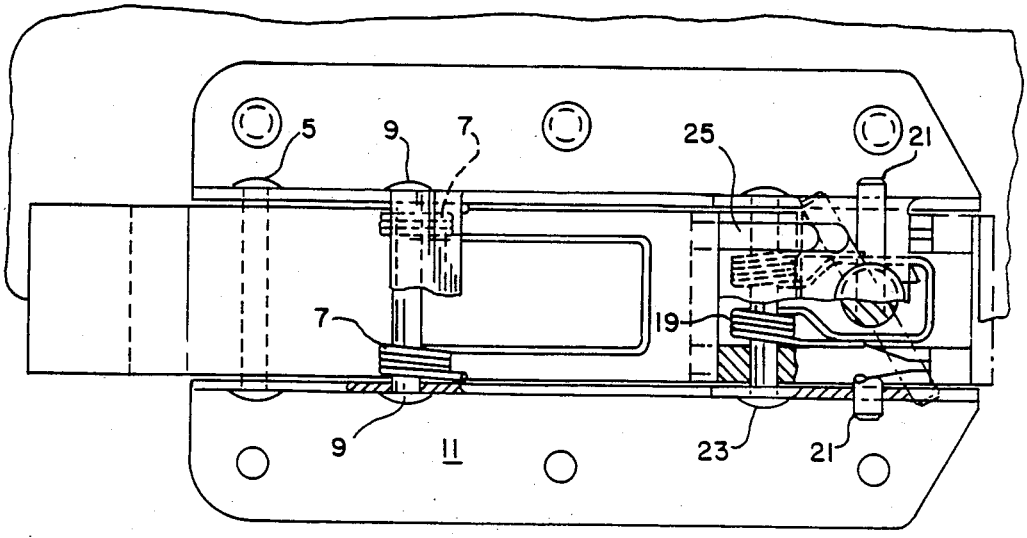
FIG. 3 is a bottom view of the latch assembly of this invention.

The configuration the latch of this invention having been described, the operation of the latch assembly 1 will now be set out. The latch bolt means 3 and the latch trigger means 15 are adapted to pivot between first predetermined positions shown in FIG. 2 where the latch assembly is latched and second predetermined positions shown in FIG. 4 where the latch assembly is unlatched. When it is desired to unlatch the latch assembly of the invention, the rotatable shaft 17 is rotated as by means of operating tool 29 such that the rotatable sleeve cross pin 21 bears upon 1 or the other of the latch trigger means leg 25. FIG. 3 illustrates the rotatable sleeve cross pin 21 in the latch position by solid line and is illustrated by dotted line as having been rotated in order to bear upon a latch trigger means leg 25. As a force is exerted against the latch trigger means leg 25, the trigger means 15 is urged to pivot about latch trigger means pivot 23 as illustrated in FIG. 4. This rotation of latch trigger means 15 as the latch bolt means recess 31 is no longer contained by the latch trigger means protrusion 33 and thus latch bolt means biasing means 7 urges the latch bolt means 3 into its second predetermined position as illustrated in FIG. 4.

When it is desired to latch the latch assembly of this invention, the latch bolt means 3 is pivoted against the latch bolt means biasing member 7 so as to compress the latch bolt means biasing member. The latch bolt means 3 is provided with a latch bolt means shoulder 39 which engages latch trigger means face 41 and urges the latch trigger means 15 to assume the first predetermined latch trigger means position as illustrated in FIG. 2. The latch trigger means biasing means 19 also urges the latch trigger means 15 to assume the first predetermined position as illustrated by FIG. 2.

While an embodiment in application of this invention have been shown and described, it will be apparent those skilled in the art that other modifications are possible without departing from the inventive concepts herein. The invention, therefore, is not to be restricted except by the scope of claims that follow.

What is claimed is:

1. A latch assembly comprising:

a latch bolt means adapted for pivotal movement about a fixed latch bolt pivot;

a latch trigger means adapted for pivotal movement and between at least first and second preselected latch trigger means positions, about a fixed latch trigger pivot, said latch trigger means including a latch trigger means interlocking means and said latch bolt means including a latch bolt means interlocking means for engaging said latch trigger means protrusion, said latch trigger means interlocking means adapted for engaging said latch bolt means interlocking means when said latch trigger means is at said first latch trigger means predetermined position and for disengaging said latch bolt means recess at said second latch trigger means predetermined position;

a shaft means adjacent said latch trigger means adapted for rotating a shaft into engagement with said latch trigger means and for pivoting said latch trigger means to said second predetermined latch trigger position said shaft means further including a frame within which said shaft is mounted; and a spring urging a shoulder of said latch trigger means away from a shoulder of said shaft means such that the pivoting of said latch trigger means from said first preselected latch trigger means position to said second preselected latch trigger means position compresses said spring.

2. The latch assembly claimed in claim 1 wherein the latch trigger means is engaged by said shaft means at a latch trigger means leg, said latch trigger means leg and said latch trigger means interlocking means being at opposed ends of said latch trigger means.

3. The latch assembly claimed in claim 1 wherein said shaft is provided with a aperature for engagement by an operating tool for rotating said sleeve.

4. The latch assembly claimed in claim 1 wherein said latch bolt means pivotal movement is further defined as between first and second preselected latch bolt means positions and said latch bolt means further includes a latch bolt means shoulder for engaging a latch trigger means face and urging said latch trigger means to rotate to said latch trigger means first position as said latch bolt means is rotated to said latch bolt means first position.

5. The latch assembly claimed in claim 4 wherein said latch assembly is latched and said latch bolt means interlocking means and said latch trigger means protrusion are engaged when said latch bolt means is in said first predetermined latch bolt means position and said latch trigger means is in said first predetermined latch trigger means position, and said latch assembly is unlatched and said latch bolt means interlocking means and said latch trigger means protrusion are disengaged when said latch bolt means is in said second predetermined latch bolt means position and said latch trigger means is in said second predetermined latch trigger means position.

6. A latch assembly comprising:

a latch bolt means adapted for pivotal movement about a fixed latch bolt pivot;

latch trigger means adapted for pivotal movement and between at least first and second preselected latch trigger means positions, about a fixed latch trigger pivot said latch trigger means including a latch trigger means protrusion and said latch bolt means including a latch bolt means recess for engaging said latch trigger means protrusion, said latch trigger means protrusion adapted for engaging said latch bolt means recess when said latch trigger means is at said first latch trigger means predetermined position and for disengaging said latch bolt means recess at said second latch trigger means predetermined position;

latch trigger means biasing means for urging said latch trigger means to assume said first preselected latch trigger means position said latch trigger means biasing means being further defined as a spring urging a latch trigger means shoulder away from a sleeve shoulder such that the pivoting of said latch trigger means from said first preselected latch trigger means position to said second preselected latch trigger means position compresses said spring;

a shaft means adjacent said latch trigger means adapted for rotating a shaft into engagement with said latch trigger means and for pivoting said latch trigger means to said second predetermined latch trigger position said shaft means further including a frame within which said shaft is mounted; and latch bolt means biasing means for urging said latch bolt means recess to engage said latch trigger means when said latch trigger means is at said first predetermined latch trigger means position.

7. The latch assembly claimed in claim 6 wherein the latch trigger means is engaged by said shaft means at a latch trigger means leg, said latch trigger means leg and said latch trigger means protrusion being at opposed ends of said latch trigger means.

8. The latch assembly claimed in claim 6 wherein said latch trigger means biasing means being further defined as a spring urging a latch trigger means shoulder away from a sleeve shoulder such that the pivoting of said latch trigger means from said first preselected latch trigger means position to said second preselected latch trigger means position compresses said spring.

9. The latch assembly claimed in claim 8 wherein said spring is coiled about said latch trigger means pivot.

10. The latch assembly claimed in claim 6 wherein said latch bolt means pivotal movement is further defined as between first and second preselected latch bolt means positions and said latch bolt means further includes a latch bolt means shoulder for engaging a latch trigger means face and urging said latch trigger means to rotate to said latch trigger means first position as said latch bolt means is rotated to said latch bolt means first position.

11. The latch assembly claimed in claim 10 wherein said latch assembly is latched and said latch bolt means interlocking means and said latch trigger means interlocking means are engaged when said latch bolt means in said first predetermined latch bolt means position and said latch trigger means is in said first predetermined latch trigger means position, and said latch assembly is unlatched and said latch bolt means interlocking means and said latch trigger means interlocking means are disengaged when said latch bolt means is in said second predetermined latch bolt means position and said latch trigger means is in said second predetermined latch trigger means position.

* * * * *